US006577817B2

(12) United States Patent
Harris

(10) Patent No.: US 6,577,817 B2
(45) **Date of Patent: *Jun. 10, 2003**

(54) WATER HEATER

(75) Inventor: Howard Harris, Ashland City, TN (US)

(73) Assignee: Howard Harris Builder, Nashville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/897,036

(22) Filed: Jul. 3, 2001

(65) Prior Publication Data

US 2003/0007790 A1 Jan. 9, 2003

(51) Int. Cl.[7] ..... F24H 1/10

(52) U.S. Cl. ..... 392/481; 392/479; 392/496; 392/498

(58) Field of Search ..... 392/449–454, 392/456, 479, 496, 497, 481, 498; 126/344, 361, 362; 122/13.1, 13.2

(56) References Cited

U.S. PATENT DOCUMENTS

| | | | |
|---|---|---|---|
| 1,560,528 | A | 11/1925 | Baum |
| 2,748,249 | A | 5/1956 | Collerati |
| 5,228,413 | A | 7/1993 | Tam |
| 5,483,642 | A | 1/1996 | Okazawa et al. |
| 5,485,879 | A | 1/1996 | Lannes |
| 5,626,287 | A | 5/1997 | Krause et al. |
| 5,838,879 | A | 11/1998 | Harris |
| 6,173,118 | B1 | 1/2001 | Harris |
| 6,198,879 | B1 | 3/2001 | Harris |

FOREIGN PATENT DOCUMENTS

| | | |
|---|---|---|
| DE | 89 10 932 | 12/1989 |
| EP | 0 323 942 | 7/1989 |
| FR | 1 255 719 | 6/1961 |
| WO | WO 00/77457 | 12/2000 |

OTHER PUBLICATIONS

International Search Report, PCT/US02/19252, Jul. 23, 2002.

*Primary Examiner*—Teresa Walberg
*Assistant Examiner*—Thor Campbell
(74) *Attorney, Agent, or Firm*—Shanks & Herbert

(57) ABSTRACT

A pressureless electric water heater for domestic use having a cylindrical double-walled tank for holding a quantity of a heat transfer liquid such as water. Cold water enters a copper coil immersed in the heat transfer liquid. The heat transfer liquid is heated by an electric heating element that extends down a double-walled top. The inner walls and the outer walls of the tank and the upper and lower walls of the top may be spaced apart using any convenient spacing distance, in order to accommodate an amount of thermal insulation, such as fiberglass, foam, cellulose or cardboard, preferably includes open air spaces between the linings of insulation or between a lining of insulation and a wall or surface.

27 Claims, 10 Drawing Sheets

WATER HEATER

BACKGROUND OF THE INVENTION

1. Technical Field

This invention relates to an electric water heater. More particularly, this invention relates to a compact electric water heater for domestic use that is pressureless, continuously self-cleaning, insulated, and energy efficient. The water heater preferably comprises insulation having multiple air spaces. The water heater also preferably includes one or more of an automatic fill switch, an inlet temperature sensor with a thermostat connected thereto, a high limit switch and a top nesting container for mounting an electric heating element. The high limit switch is preferably connected to a sensor plate. The sensor plate detects the temperature of the heat transfer liquid in the tank. By detecting the temperature of the heat transfer liquid in the tank as opposed to detecting the temperature of the water in the coil, a more accurate reading of the temperature of the heat transfer liquid in the tank is obtained.

2. Background Art

Conventional domestic electric water heaters include a steel tank, insulated by foam encased in a metal jacket. Cold water runs into the steel tank. The cold water is heated by lower and upper heating elements. Hot water exits through a pipe. While hot water is drained from the pipe, cold water mixes with the remaining hot water thus reducing the temperature of the remaining water.

In a conventional electric water heater, minerals typically settle out from the water to form sediments. Accumulation of sediments can eventually cause corrosion and leaks thereby reducing the heater's efficiency. These inefficiencies lead to increased costs of heating. Furthermore, heat and occasionally excessive pressure of water entering the system from the cold-water source is generated in the tightly sealed tank. Property damage and personal injury can result from steam and water leaving the pressure relief valve or from explosion due to a failed valve.

Heating elements in conventional electric water heaters often fail before tank fail, and thus must be replaced more frequently than tanks. Replacement of the elements is a difficult task in conventional domestic electric water heaters and usually requires that the water supply be shut off and that the tank be drained prior to replacing the element.

Conventional electric water heaters have several safety drawbacks. They are typically constructed of a single layer of metal. The single layer of metal can be a hazardous condition when a person comes in contact with the unit or the metal due to repairs or through casual contact. Conventional electric water heating units may also have electrical wires positioned near the metal surface, which if contacted by a frayed or loose live wire, could cause electric shock and significant injury to an individual.

Another drawback of conventional water heater is that the many metal parts are prone to corrosion. The metal parts are also thermally conductive and are not ideal for insulating the heated water from ambient temperatures.

SUMMARY OF THE INVENTION

One object of the electric water heater of the present invention is to provide an efficient and inexpensive means for controlling the heating element within a hot water tank such that the temperature of the water is consistently kept at a desired temperature.

Another object of the present invention is to provide an electric water heater comprising: a tank having an inner wall and an outer wall wherein said inner wall and said outer wall are separated by a first open space region and said first open space region is filled at least partially with thermal insulation; further wherein said water tank is adapted to hold a quantity of non-pressurized and non-circulating heat transfer liquid; a top adapted to be separated from said tank, said top having an upper wall and lower wall wherein said upper wall and said lower wall are separated by a second open space region and said second open space region is filled at least partially with thermal insulation; at least one thermally conductive coil adapted to circulate water from a water inlet, said coil being mounted inside said tank and having said water inlet and a water outlet in communication with an exterior of said tank, further wherein said water inlet and said water outlet each extends outside of said water heater; at least one heating element attached to said top and positioned to extend downwardly through said top and heat said heat transfer liquid within said tank; a sensor plate in communication with said coil in a position proximate to said water inlet and wherein said sensor plate extends from said top to said coil; a thermostat connected to said sensor plate, wherein said thermostat is in thermal proximity with said sensor plate such that it activates said heating element when the temperature signaled by said sensor plate reaches a predetermined temperature; and wherein said heating element contacts and heats the heat transfer liquid inside the tank and said heat transfer liquid contacts said coil to heat water from a water supply that enters said water heater and circulates through said coil such that heated water leaves said water outlet.

It is another object of the present invention to provide an electric water heater comprising: a tank having an inner wall and an outer wall wherein said inner wall and said outer wall are separated by at least a single first open space region and said first open space region is filled at least in part with thermal insulation; further wherein said water tank is adapted to hold a quantity of non-pressurized and non-circulating heat transfer liquid; a top adapted to be separated from said tank, said top having an upper wall and lower wall wherein said upper wall and said lower wall are separated by at least a single second open space region and said second open space region is filled at least in part with thermal insulation; said top further having an opening that can receive a heating element mount adapted to extend downwardly inside and fluidly communicate with said heat transfer fluid, wherein said mount is sealing engaged in said opening and held in place by a gasket and a lip having a larger diameter than said opening, at least one thermally conductive coil adapted to circulate water from a water inlet said coil being mounted inside said tank and having said water inlet and a water outlet in communication with an exterior of said tank, further wherein said water inlet and said water outlet each extends outside of said water heater; at least one heating element mounted on said heating element mount and positioned to extend inside said heat transfer liquid within said tank; a sensor block in communication with said coil for receiving water from said coil and returning water to said coil; and a thermostat mounted on a side of said heating element mount and in thermal proximity to said sensor block such that it activates said heating element when water temperature signaled by said sensor block reaches a pre-determined temperature.

DESCRIPTION OF THE PREFERRED EMBODIMENT

Figure 1:
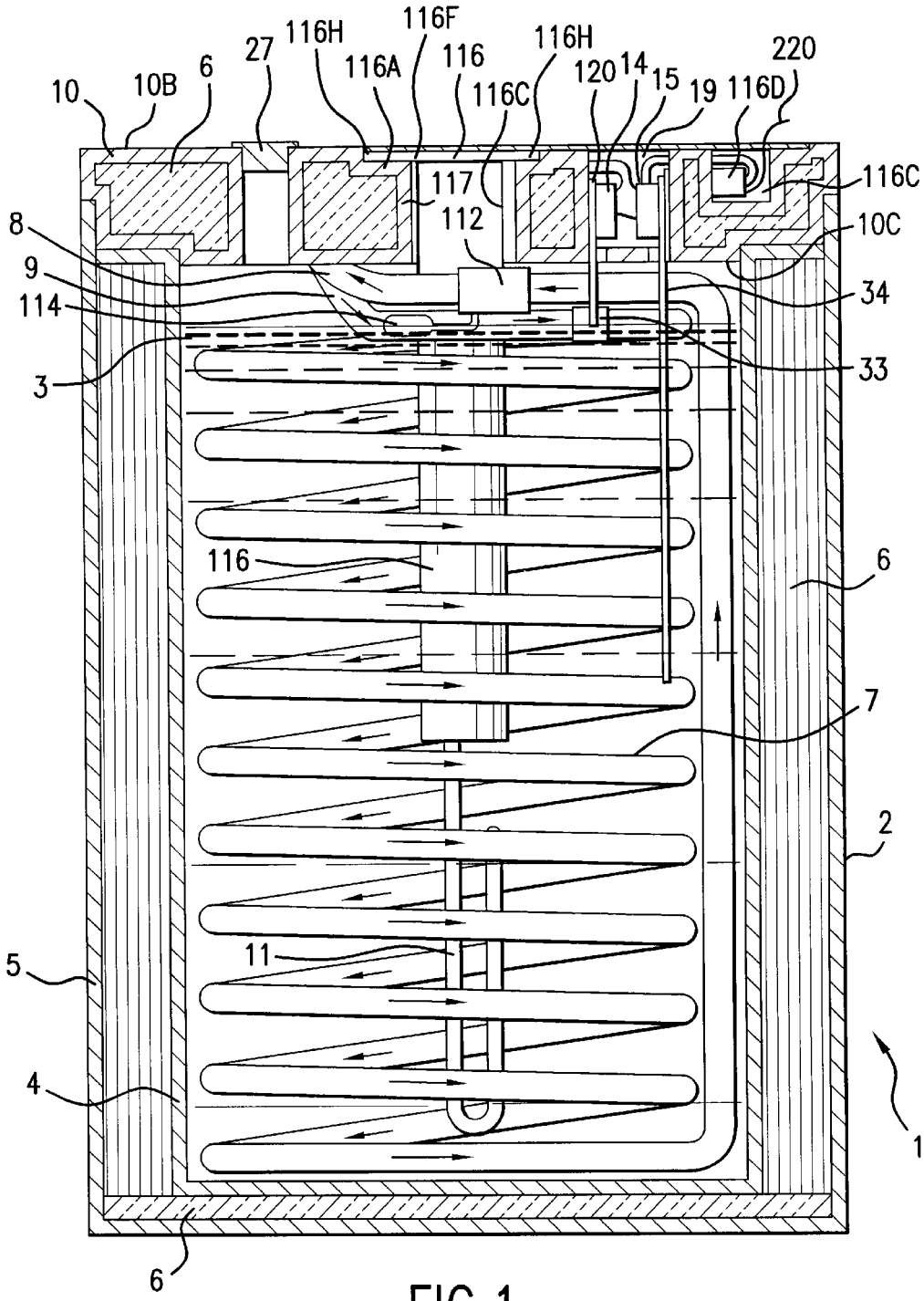
FIG. 1 shows a cross-sectional side view of a water heater with insulation according to the present invention.

Applicant's invention will be best understood when considered in light of the following description of the embodiments of the invention as illustrated in the attached drawings wherein like reference numerals refer to like parts. The embodiments of the figures are preferred embodiments, but do not restrict the scope of the invention.

Figure 2:
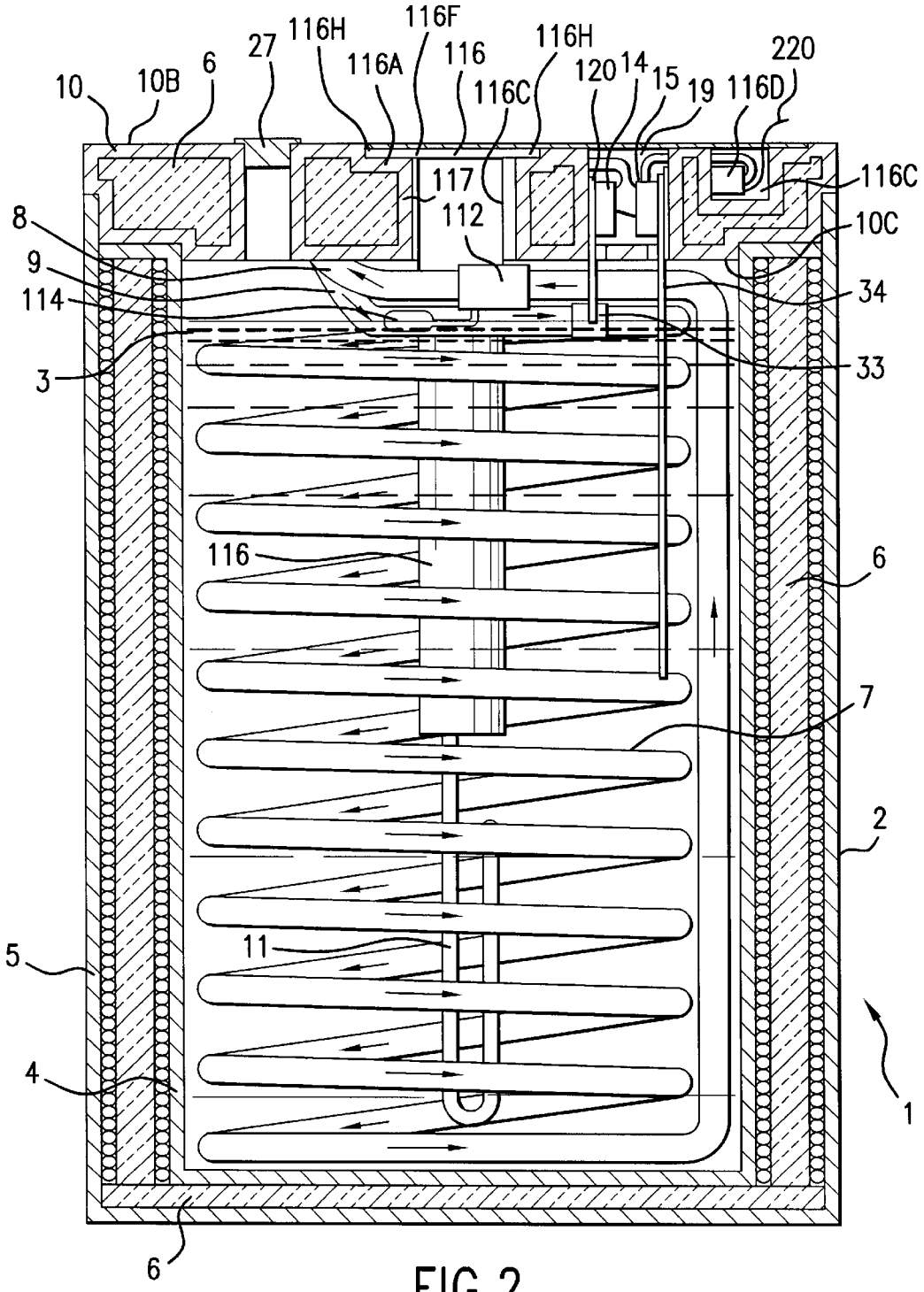
FIG. 2 shows a cross-sectional side view of a water heater with air space, cardboard and foam insulation according to the present invention.
Figure 3:
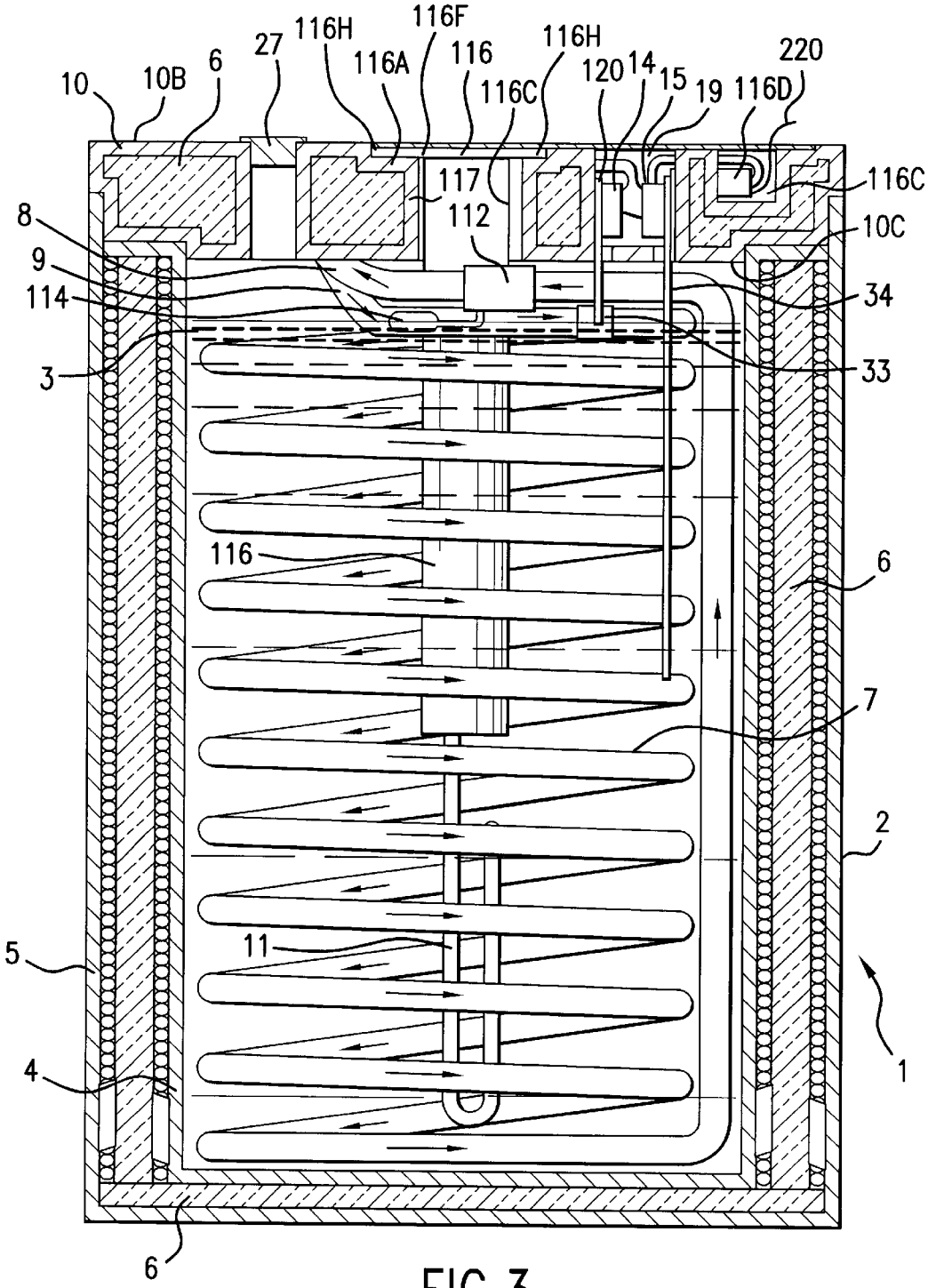
FIG. 3 shows a cross-sectional side view of a water heater with air space and cardboard insulation having a metallic foil reflector shield on the cardboard according to the present invention.

FIGS. 1, 2, and 3 illustrate a water heater according to the present invention generally indicated as 1. The water heater has a cylindrical tank 2 having inner walls 4 and outer walls 5, preferably made of plastic, such as polypropylene, although many types of plastic may be used. Plastic is desirable because it is dent resistant, non-corrosive, and has low thermal conductivity. In use, the tank preferably contains a sufficient quantity of heat transfer fluid to cover a plurality of coils 7 positioned inside the tank. The coils 7 may be finned outside and corrugated inside to maximize heat transfer. The coils are preferably continuously connected copper tubing. The inner walls 4 and outer walls 5 may be spaced any convenient distance apart depending on amount of insulation and air spaces, but are preferably about two to three inches apart. A first open space region 2E, shown in more detail in FIGS. 4 and 5, between the inner wall 4 and outer wall 5 is filled with a thermal insulation material 6 preferably made from cellulose, cardboard, corrugated cardboard, foam or cellulose fibers. The insulation material may also be recyclable paper. Corrugated cardboard, which provides additional air spaces between corrugations, is also a preferred insulation material. A combination of different insulation materials may also be used. Foam insulation is commonly used in water heaters known in the art, but may split or crack, oftentimes due to thermal expansion and contraction, drying out, or simply age. These cracks may cause a decrease in the water heater's efficiency. Cellulose insulation is more stable and more preferred than foam insulation. Preferably, the open space region 2E, will be layered with insulation material 6 in such a manner as to provide an air space 2A between an outer wall and a first layer of corrugated card board, another air space 2A between the first layer of corrugated cardboard and a layer of foam, and yet another air 2A space between the layer of foam and a second layer of corrugated card board followed by an additional air space 2A between the second layer of cardboard and an inner wall.

Additionally, a material to reflect radiant energy may be used in the insulation to increase its effectiveness. A preferred method is to use one or more layers of a metallic foil such as aluminum foil.

Figure 4:
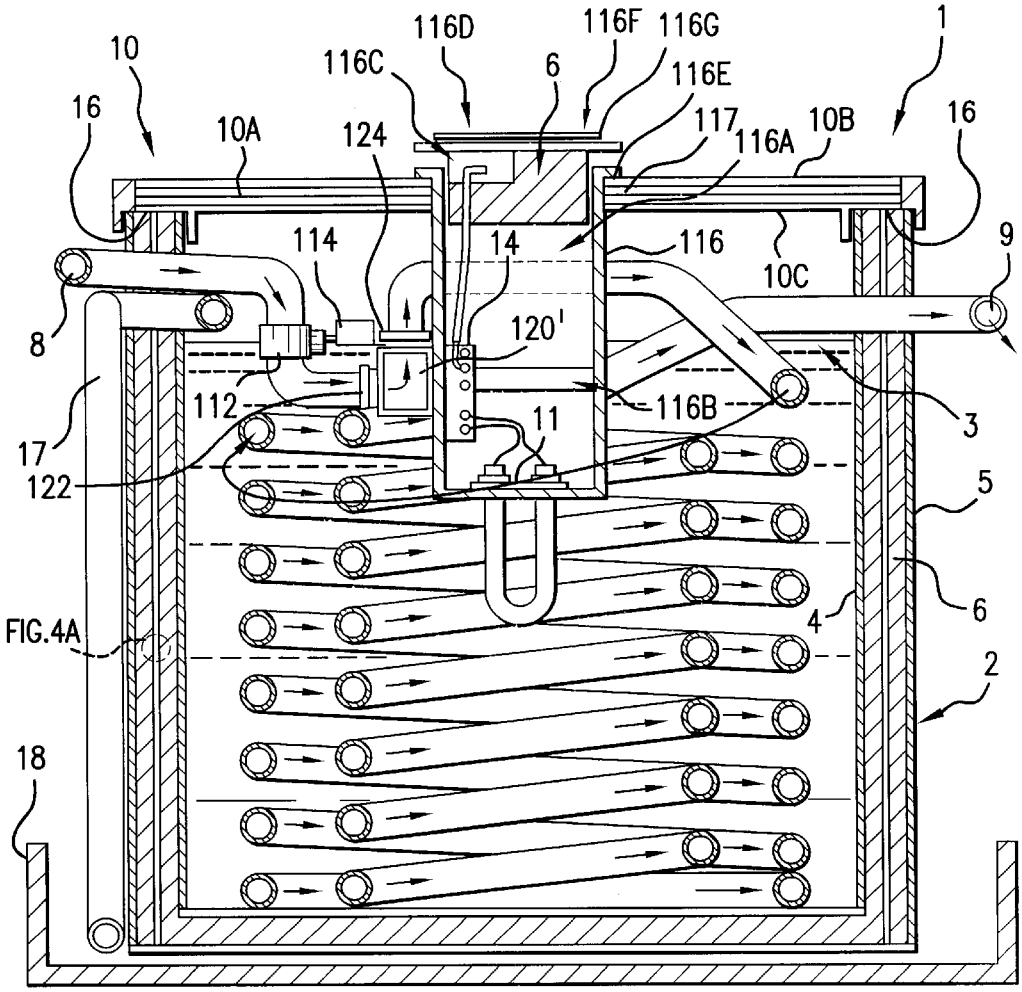
FIG. 4 shows a cross-sectional side view of another embodiment of a water heater according to the present invention.
Figure 4A:
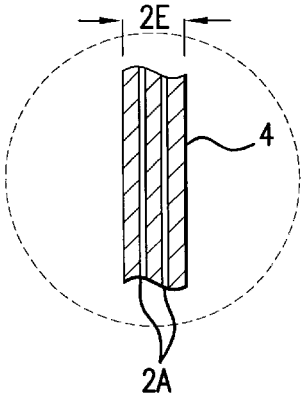
Figure 4B:
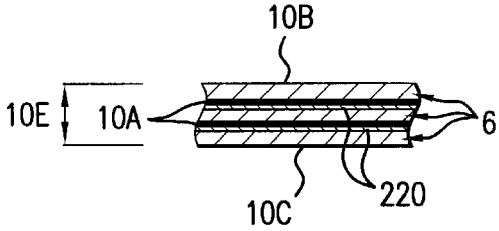

As shown in detail in FIG. 4, open regions of space 2E and 10E are preferably incorporated to further improve the efficiency and energy saving capabilities of the water heater unit. Additionally, the tank 2 may contain multiple open space regions 2A separated by thermal insulation 6, thereby further increasing the efficiency of the water heating unit 1. The top 10 is preferably insulated with foam.

In addition, the inner walls 4 and outer walls 5 of the tank, along with the upper wall 10B and lower wall 10C of the top 10 are typically constructed of a plastic material such as polypropylene, however other similar materials may be used for construction. Polypropylene has low thermal conductivity, is not electrically conductive, is dent resistant, lightweight, and inexpensive to manufacture. All are very desirable properties for a water heater.

Spaces that exist between the inner walls 4 and outer walls 5 of the tank 2 and between the upper walls 10B and lower walls 10C of the top 10 may be insulated with thermal insulation 6 or preferably integrated cardboard and air spaces 2A. The thickness of the thermal insulation 6 may vary to give the desired insulation. Preferably there is a volume of open space in the insulation lining between the inner and outer walls. The plurality of open spaces lined with thermal insulation, allows for a substantial reduction in the escape of heat through thermal conductive transfer. Increased heat retention by the water heater provides for greater energy efficiency. Furthermore, open spaces in the insulation substantially reduce or prevent atmospheric temperature from adversely affecting the internal temperature of the tank.

Greater thickness of the lining of insulation results in greater efficiency of the water heater. For example, tank walls spaced 4 inches apart result in a water heater of greater efficiency than a water heater with tank walls spaced 2 inches apart because of the greater width of the breakage in thermal contact. Preferably, the open space region 2E between inner walls 4 and outer walls 5 and the open space region 10E between the upper wall 10B and lower wall 10C is fractionally filled with a thermal insulation material 6, e.g., foam thermal insulation, in order to form a lining on at least one wall's surface.

The insulation lining on a wall may have a thickness of about ¼ of an inch (6.4 mm) to about 3 inches (7.6 cm), but should preferably have a thickness of about 1 inch (25.4 mm). The distance across the first open space region 2E, measured along a line perpendicular to the foam lining on each wall should have a distance of at least about ⅛ of an inch (3.2 mm) between the linings of insulation or between a lining of insulation and a tank wall in order to sufficiently cause a breakage in thermal contact. Preferably, the distance across the first open space region 2E measures about ¼ of an inch (6.4 mm) to about ½ of an inch (13 mm).

Conventional electric water heaters often do not incorporate a design using double walled construction of the plastic tank 2. The improved design of one embodiment of the present invention has the outside of the tank larger and taller than the inside of the tank, which prevents leakage from the inner tank wall 4. By controlling leakage, the water heater is prevented from causing water damage to the surrounding areas. In addition, using plastic instead of metallic materials for the tank prevents conduction of electrical current and thus provides a safer electric water heater than conventional models.

As shown in FIG. 1, the double-walled top 10 supports at least a single conventional electric heating element 11. The heating element 11 is secured to a heating element mount 116 extending downward inside the tank 2 and beneath the surface of a heat transfer liquid 3. A typical heat transfer liquid 3 is water, however DOWTHERM® or DOW-FROST® available form Dow Chemical are suitable heat transfer liquids. The heating element mount 116 has a diameter larger than a center hole 117. The element mount rests atop of center hole 117 and is held in place by a lip section 116H found in the top thus forming a proper seal between the center hole 117 and a cover plate 116F.

A thermostat 14, also of conventional design, can be mounted on a thermostat sensor plate 120. The thermostat sensor plate extends from the water inlet coil up through a second hole 19 in the tank's top positioned adjacent to the center hole 117. The thermostat 14 controls electric power to the heating element 11 for regulation of the temperature of the tank fluid 3. The thermostat 14 can be held in place on the thermostat sensor plate 120 by a spring tension clip 50 (shown in FIG. 9) or by any other fastening means. A wire 220 passing through a channel 22 in the top 10 at a point above the high limit switch 15 and thermostat 14 are also provided. The wire 220 provides for electrical communication between an electrical wiring box, the thermostat 14 and the sensor plate 120.

A sensor plate 120 is preferably a thin copper plate and is preferably fixedly connected to a sensor 33. The sensor 33 is preferably welded onto the cold-water inlet 8. The sensor plate 120 is preferably about 24 inches inside the tank on the coil 7. As hot water is drawn, cold water circulating through the coils cools the sensor plate 120. The change in temperature of the sensor plate 120 signals the thermostat 14, which in turn signals the heating element 11 to heat the water in the tank 2. The signal is produced until the water reaches a pre-set temperature. Once this pre-set temperature is reached, the thermostat 14 turns off the heating element 11.

Generally having the sensor plate 120 at the beginning of the coil inside the tank when a hot water faucet runs or drips, causes the thermostat to continuously run due to cold water entering the coil and thermally cooling the sensor plate 120. Subsequently, the water heater will heat to a higher temperature than that for which the thermostat is preset, causing the high limit switch 15 to shut down the water heater. The high limit switch 15 is fixedly connected to a high limit switch sensor plate 34, which extends downward into the water and senses the water temperature in the tank. The sensor plate 34 does not sense the water in the coil 7. This provides for a more accurate reading of the water temperature in the tank.

Also, when a sensor is positioned close to the cold-water inlet 8, the thermal conductivity of the incoming cold water provides a false reading of the temperature of the water in the tank. When the incoming water temperature drops below 60° F. (16° C.), the thermostat reading begins to change. The colder the incoming water, the lower the thermostat temperature reading. Thus, the thermostat temperature reading in the tank will be higher than the pre-set thermostat temperature setting. Generally, if the sensor is too close to the incoming cold water line, the cold water will cause a lower reading. When the sensor is positioned further inside the tank, the hot water in the coil 7 offsets the thermal conductivity of the cold water in the cold water line.

It is preferred that the sensor plate 120 be positioned about 24 inches (61 cm) inside the tank on the coil 7 inside the tank 2 to prevent over heating. Accordingly by positioning the sensor plate 120 about 24 inches (61 cm) on the coil 7, the thermal conductivity of a leaking pipe or a dripping faucet will not affect the thermostat sensor and cause continuous heating. Thus, the thermostat will operate as designed or predetermined.

An opening 116C, constructed of a plastic material or its equivalent such as polypropylene is designed to insulate and contain an electrical wiring box 116D. The electrical wiring box 116D provides for an electrical connection between the power supply and the thermostat 14, and the high limit switch 15 and the heating element 11.

As shown in FIGS. 1–4, a float 114 is attached to the cold water inlet 8. The float 114 measures the water level in the tank and fills the tank through an automatic valve 112 when the water level in the tank falls below the necessary level. In a preferred embodiment, the automatic valve 112 is an in-line T-shaped connective joint. However, due to displacement of water by the heating element mount 116, the automatic valve 112, which may be a float valve, should be turned-off when the heating element mount 116 is removed to prevent overfilling of the water tank and causing unnecessary overflow.

FIG. 4 illustrates another embodiment of the present invention. A double-walled insulated top 10 supports at least a single conventional electric heating element 11 that is secured to a heating element mount 116. The top 10 has an opening 116A. The mount 116 is inserted through the opening 116A in top 10, and extends downward inside the tank 2 beneath the surface of the tank water 3 and may be held in place by, gasket 116E and a lip and screws (not shown) that is larger in diameter than the opening 116A. Thus forming a proper seal between the opening 116A and the mount 116. A thermostat 14, also of conventional design, can be mounted on one side of the heating element mount 116, in thermal proximity to a sensor block 120' in the coil line. The thermostat 14 controls electric power to the heating element 11 for regulation of the temperature of the tank water 3. The thermostat 14 can be held in place by a flexible clip 116B that has the capability to be bowed, thereby securing the position of the thermostat 14 inside the heating element mount 116.

An insert 116C, as shown in FIG. 4, preferably constructed of a plastic material, is designed to insulate and contain an electrical wiring box 116D. The insert 116C is placed into the opening 116A of the heating element mount 116. In addition, a third gasket 116G resides where the insert 116C contacts the electric heating mount 116 in order to ensure a proper seal between the elements, fastened by screws.

As shown in FIG. 4, the top 10 can simply rest atop of inner walls 4 and outer walls 5 of the tank 2. Preferably, the top 10 is fastened to the tank 2 using any conventional type of fastening device which allows for removal of the top 10, including but not limited to clamps, latches, or screwing the top 10 onto the tank 2 using one or two pairs of mating threads or screws 26 on the top 10 and the inner wall 4 and/or outer wall 5 (See FIG. 4). Gaskets 16 are used to ensure a proper seal between the top 10 and the tank 2 to prevent any significant loss of heat.

As shown in FIG. 4, a water heater 1 has a top 10 that includes a center hole 117. A heating element mount 116 descends through the center hole 117 into the tank water, preferably positioning the heating element 11 at approximately the center of the tank. A plastic lid 116F (See FIG. 4) covering the insert 116C, electrical wiring box 116D, and gasket 116E, is preferably insulated and used to cover the hole to limit heat loss through the center hole 117. A thermostat 14 is preferably attached in close thermal contact with an inner wall of the mount 116. The thermostat 14 can be held at the correct depth within the mount 116 using a depth extension holder 116H in order to position the thermostat, and sensor block 120', at least 2 inches (5 cm) below the water line within the tank 2. The outer walls 5 of the container fit tightly against the sensor block 120'. The coil 7 is attached to the sensor block 120'. Because of the thermostat's position against the sensor block 120', the heating element 11 will begin heating or raising the water temperature in the tank while water is being extracted from the coils 7. Timing the heating to coincide with use raises the efficiency of the water heater.

The sensor block 120' is preferably a hollow block through which the incoming cold water flows before passing through the coiled section. The sensor block 120' may also be an in-line sensor block. The sensor block 120' is placed in close proximity with the thermostat 14. The sensor block 120' should preferably be aligned with the thermostat to improve the thermal contact between the devices. As hot water is drawn, cold water circulates through the sensor block 120', thereby cooling the thermostat 14. The sensor block 120' could be configured in various ways to allow the flow of water. In particular, the connectors 122 and 124 for bringing water through the sensor block 120' may be positioned on different faces of the sensor block 120' or on the same face, vertically or horizontally. The sensor block 120' preferably is made of any thermoconductive metal.

As shown in FIG. 4, an optional overflow pipe 17 may be located above the water level of the tank 2 or the second open space region which is located between the top surface of the tank water 3 and the top 10. The overflow pipe extends horizontally through the second open space region and through the inner walls 4 of the tank and then vertically downward along the outer walls 5 of the tank 2. The overflow pipe 17, if present, runs to an overflow pan 18 in which the water heater 1 sits.

It should be noted that the only pressurized water is in the coil. This provides a safety advantage over electric water heaters known in the art. If the water pressure is increased until the water heater failed, the burst would be contained by the heat transfer fluid, the inner wall 4, the outer wall 5, and the top 10 of the heater. Therefore, there is also no need for a pressure relief valve as is required by water heaters know in the art.

Figure 5:
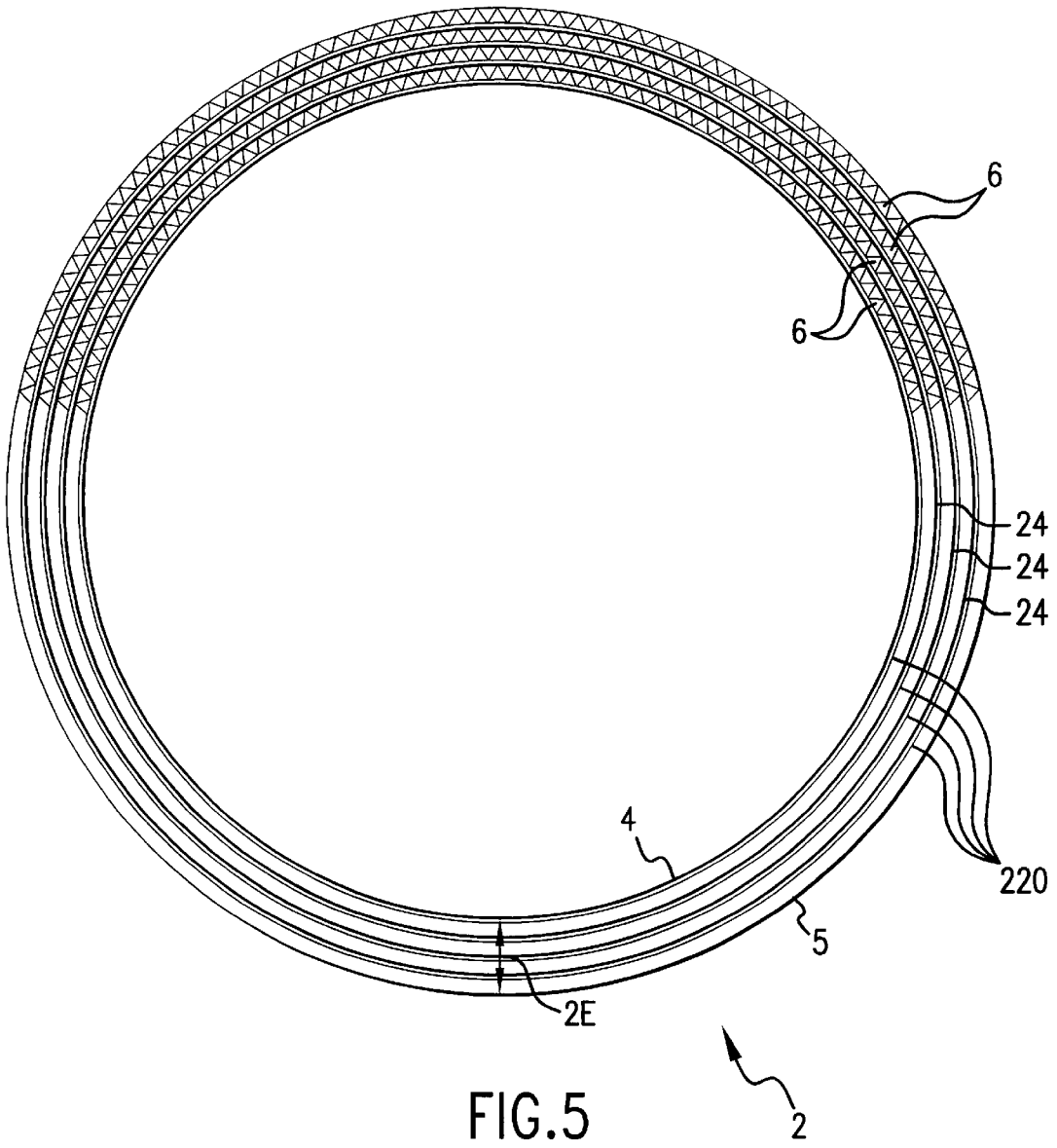
FIG. 5 shows a cross-sectional view of a tank wall having a cardboard insert according to the present invention.

In another embodiment of the present invention, shown in FIGS. 4 and 5, the insulation in the top 10 and tank 2, each of which contain at least a single open space region 10E, are designed to accommodate the elements of the preferred embodiment. The detailed cut-away of FIG. 4 depict a double-walled top 10, having an upper wall 10B and a lower wall 10C, with an open space region 10E existing between the walls. FIG. 5 depicts a double-walled tank 2, having an inner wall 4 and outer wall 5, with an opens space region 2E existing between the walls. An amount of thermal insulation 6, such as fiberglass, foam, cellulose, corrugated cardboard or cardboard is introduced to one or more of the open space regions 2E and 10E in order to form a lining on at least one wall's surface.

The insulation material may also be recyclable paper. Corrugated cardboard, which provides additional air spaces between the corrugations, is a preferred insulation material. A combination of these may also be used. Preferably, the open air space 2E and 10E, will be layered to provide an air space 2A and 10A between an outer wall and a first layer of corrugated card board, another air space 2A and 10A between the first layer of corrugated cardboard and a layer of foam, and yet another air space 2A and 10A between the layer of foam and a second layer of corrugated card board followed by an additional air space 2A and 10A between the second layer of cardboard and an inner wall.

The lining on a wall may have a thickness of about ¼ of an inch (6.4 mm) to about 3 inches (7.6 cm), but should preferably have a thickness of about 1 inch (25.4 mm) such that the distance across the open space regions 2E and 10E, when measured along a line, perpendicular or any other suitable direction, to the lining on each wall, should have open air spaces 2A and 10A that provide a distance of at least about ⅛ of an inch (3.2 mm) between the linings of insulation or between a lining of insulation and a tank wall in order to sufficiently cause a breakage in thermal contact. However, the distance across the open space regions 2E and 10E preferably measures about ¼ of an inch (6.4 mm) to about ½ of an inch (13 mm).

This top 10 is configured so that it can receive and support at least a single conventional electric water heater element 11 or may accommodate at least a single conventional electric heating element 11 that is secured to a heating element mount 116 inserted through a center hole 117 in the top 10.

Figure 6:
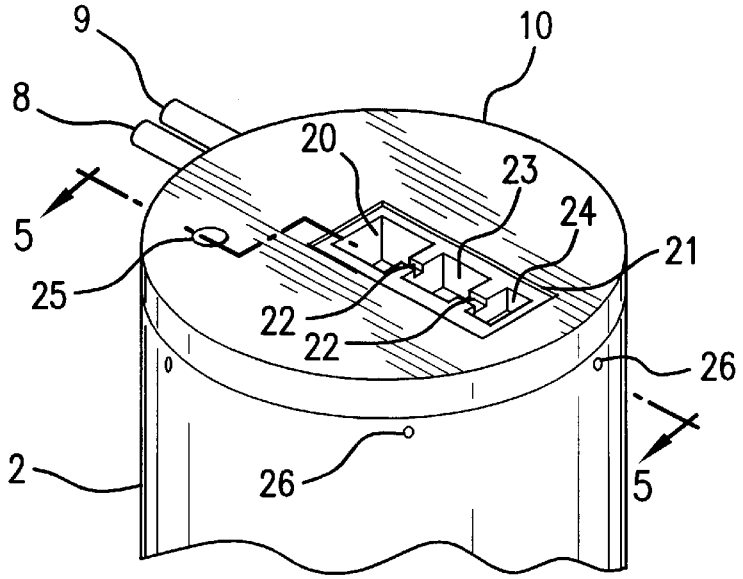
FIG. 6 shows a perspective view of a top section of a water heater tank with recesses according to the present invention.

FIG. 6 shows a section of the water heater tank 2 including the top 10 and the tank outer wall 5 according to another embodiment of the present invention. The top 10 and the outer wall 5 are preferably made of polypropylene or any similar synthetic material. The top 10 comprises a cover plate cavity 21 for receiving the heating element 11, sensor pipe 120 and thermostat 14. The cover plate cavity 21 may be located anywhere on the top surface such that the cover plate cavity 21 is easily accessible for inserting elements such as the heating element 11, sensor pipe 120, thermostat 14, and high limit switch 15. The cover plate cavity 21 houses a heating element insert cavity 20 for receiving an electric heating element 11, an electrical wire channel 22 to connect the wiring, a thermostat cavity 23, and an electrical box cavity 24. The cavities 20, 23, 24 and electrical wire channel 22 may be arranged in any suitable manner. The top also houses a fill plug cavity 25, which may be positioned in any suitable position on said top 10. The fill plug cavity allows for an additional means for filling the water heater upon installation. The cold water inlet 8 and hot water outlet 9 are also shown in FIG. 6. Cold water to be heated inside the tank 2 enters the coil 7 at a cold-water inlet 8, circulates through the finned tube coils, and exits through the hot water outlet 9. The top 2 may be secured to the tank via attaching screws 26.

Figure 8:
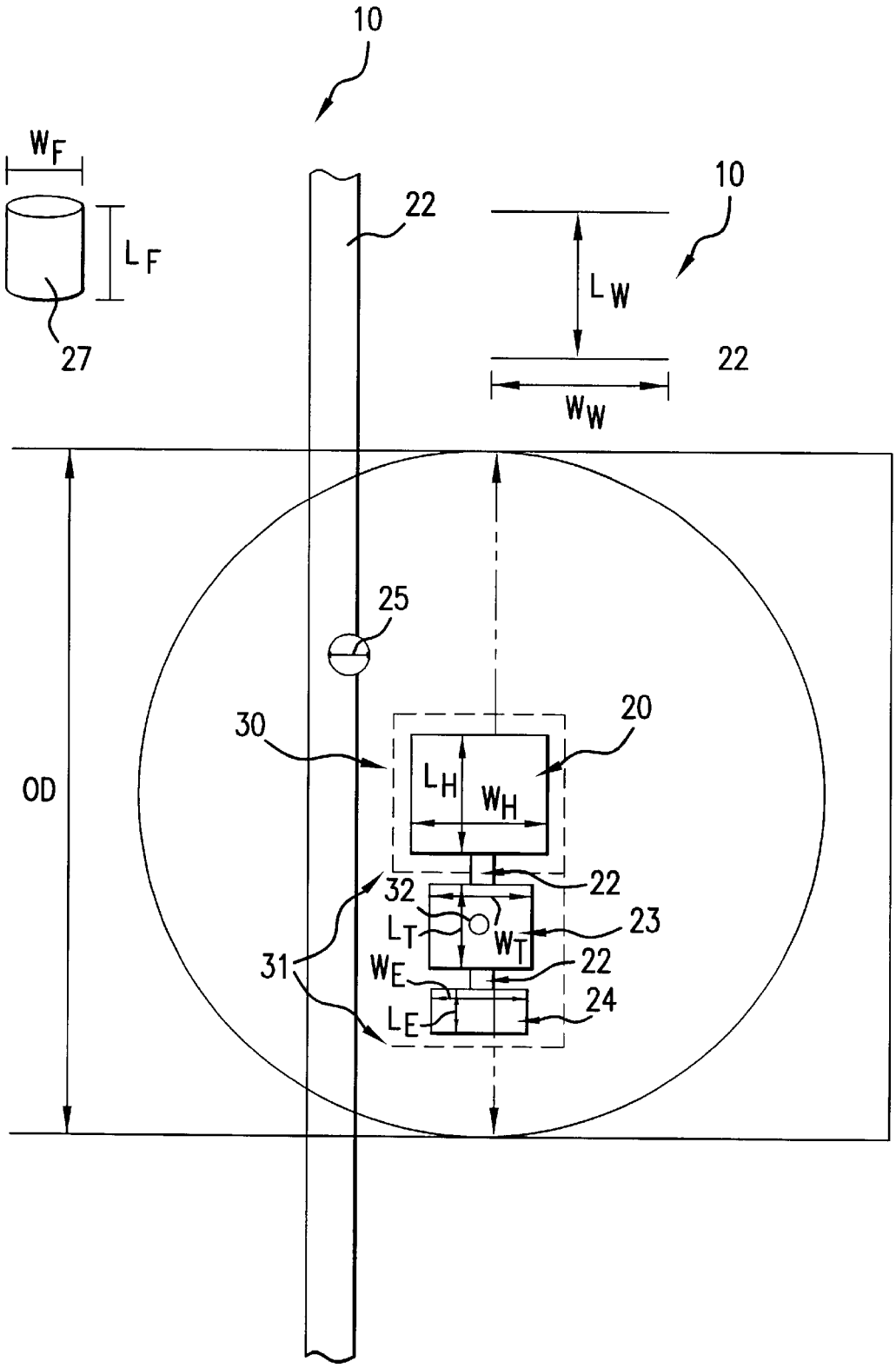
FIG. 8 shows a top view of a water heater top with recesses according to the present invention.

As shown in FIG. 8, the electrical box cavity 24 is preferably a length $L_W$ of about ¼ inch (6.4 mm) and a width $W_W$ of about 1 inch (25.4 mm). A fill plug 27 for inserting in the fill plug cavity 25 is preferably a length $L_F$ of about 3 inches (7.6 cm) and a width $W_F$ of about 2 inches (5.1 cm)

and is about 1½ inches deep (38 mm). The fill plug cavity 25 preferably has a diameter $d_F$ of about 2 inches (5.1 cm). The outside diameter OD of the top is preferably about 23 inches (58.4 cm). In a preferred embodiment of the present invention, the heating element cavity 20 is adjacent the thermostat cavity 23 and the thermostat cavity 23 is adjacent the electrical box cavity 24, in such a manner that the thermostat cavity 23 and high limit switch cavity are between the heating element cavity 20 and the electrical box cavity 24. The electrical wire channel 22 preferably lies beneath the cover plate and is in communication with the cavities 20, 23, and 24. There is preferably a first recess 30 and a second recess 31 in said cover plate cavity 21. The first recess 30 supports the heating element cavity 20 and is preferably about ¼ of an inch (6.4 mm). The second recess 31 supports the thermostat cavity 23 and the electrical box cavity 24 and is preferably about ⅛ of an inch 3.2 mm). The heating element cavity 20 is preferably a length $L_H$ of about 4⅛ inches (10.5 cm) and a width $W_H$ of about 4⅛ inches (10.5 cm). The thermostat cavity 23 is preferably a length $L_E$ of about 3 inches (7.6 cm), a width $W_E$ of about 3 inches (7.6 cm), and a depth of about 3 inches (7.6 cm). The electrical box cavity 24 is preferably a length $L_T$ of about 2 inches (5.1 cm), a width $W_T$ of about 3 inches (7.6 cm), and a depth of about 1½ inches (38 mm). The thermostat cavity 23 also has a hole 32 for a pipe sensor.

Figure 7:
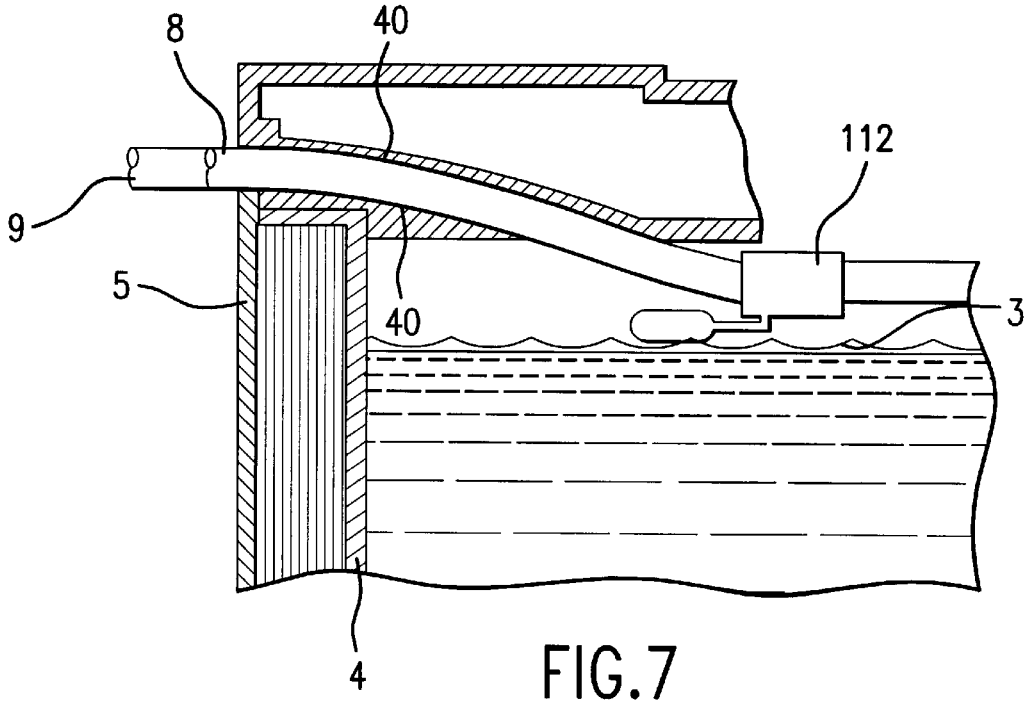
FIG. 7 shows a cross-sectional cut-away view of a portion of a water heater top and sidewalls shown in FIG. 3 taken along lines 5—5.
Figure 10:
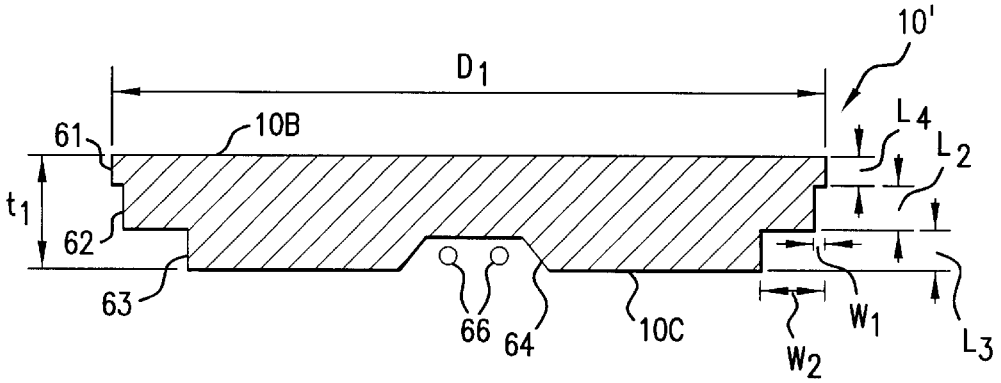
FIG. 10 shows a cross sectional side view of a top of a water heater according to preferred dimensions of the present invention.

As shown in FIG. 7, a channel 40 is molded inside a lower section of the top 10 to house the cold-water inlet 8 and hot water outlet 9. FIG. 10 shows an arch 64 in the bottom of the top 10, which allows the pipes 8 & 9 to exit.

Figure 9:
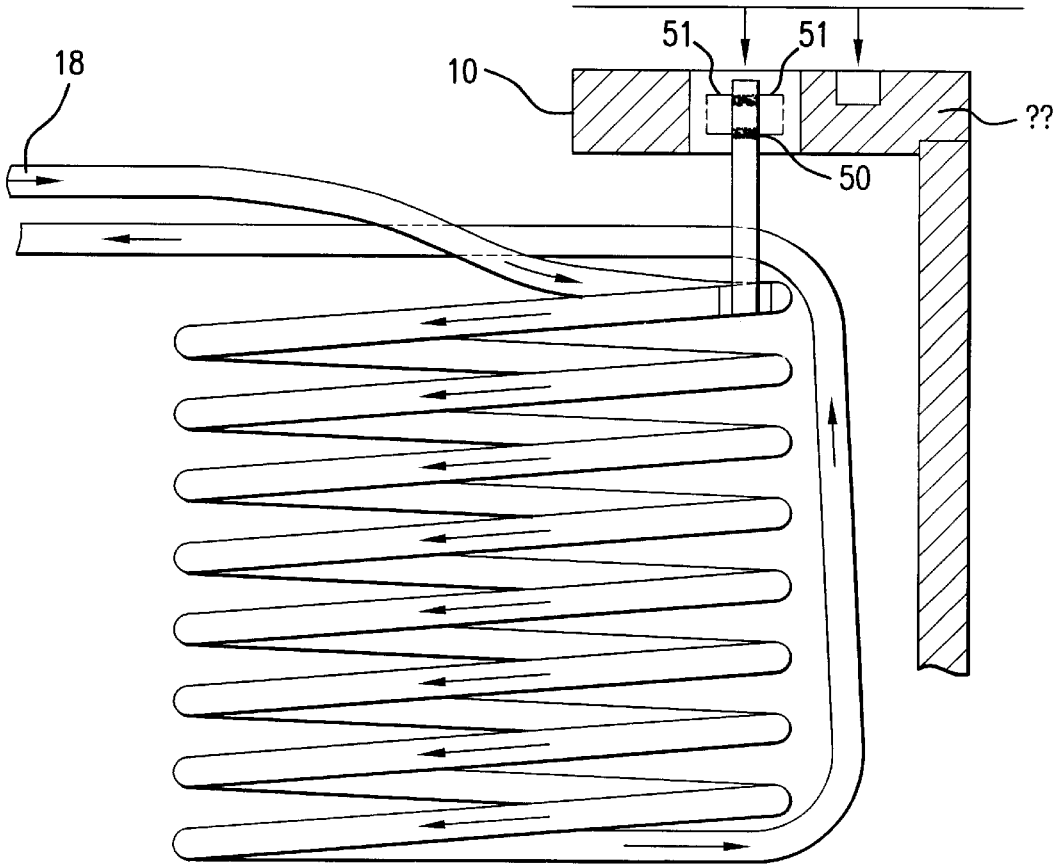
FIG. 9 shows a side view of a plurality of water heater coils together with a sensor pipe and thermostat combination according to an embodiment of the present invention.

In another embodiment of the present invention shown in FIG. 9, the thermostat and high limit switch are a single unitary body 51 and is connected to a sensor (not shown) via springs 50.

Referring to another embodiment of the present invention shown in FIG. 10, the top 10' is preferably a thickness $t_1$ of about 3¼ inches (8.3 cm) and a diameter $D_1$ of about 23 inches (58.4 cm). The top 10' is machined to have three levels wherein the first level 61 overhang the second level 62 and the second level 62 overhangs the third level 63. The first level 61 preferably proceeds downward from the upper wall 10B a distance $L_1$ of about 1¼ inches (31.8 mm) and offsets the second level 62 by a width $W_1$ of about ⅛ of an inch (3.2 mm). The second level 62 preferably proceeds downward from the first level 61 a distance $L_2$ of about 1¼ inches (31.8 mm) and offsets the third level 63 by a width $W_2$ of about 2⅜ inches (6 cm). The third level 63 preferably proceeds downward from the second level 62 a distance $L_3$ of about ¾ of an inch (19 mm). There is preferably a cut-away section 64 in the lower wall 10C. The cut-away section 64 is preferably in an arch shape and is suitable to accommodate at least two pipes 66 each having a ¾ of an inch (19 mm) outside diameter.

Figure 11:
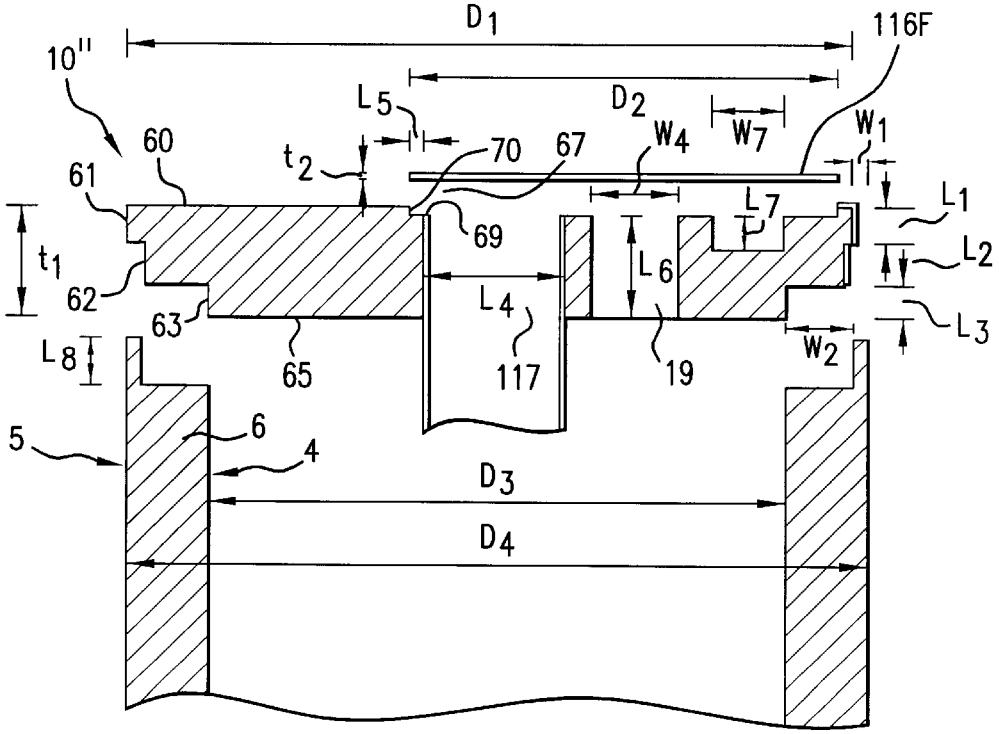
FIG. 11 shows a cross sectional side view of a water heater according to preferred dimensions of the present invention.
Figure 12:
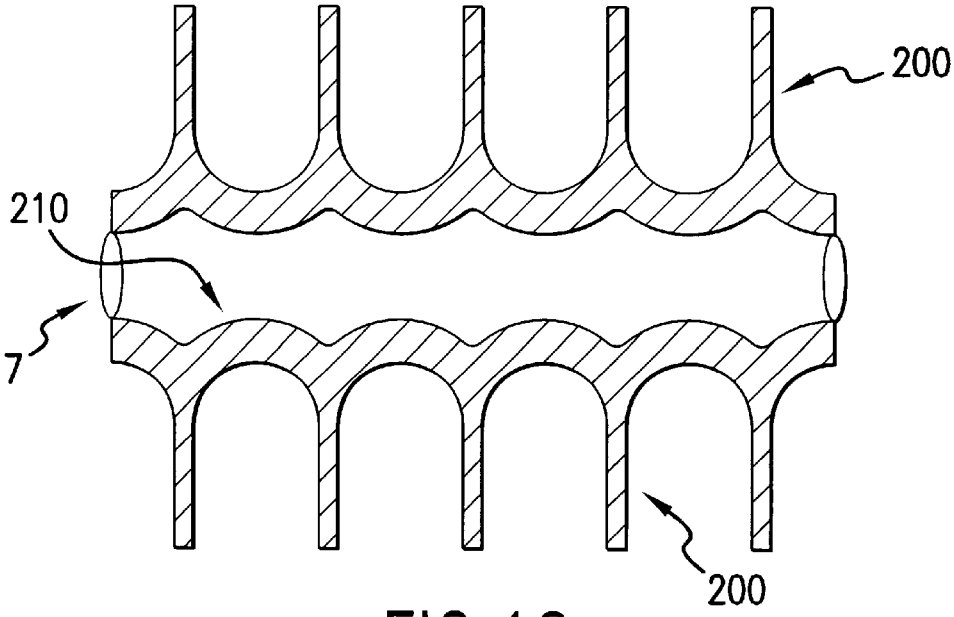

Referring to yet another embodiment of the present invention shown in FIG. 11, the top 10" has the same dimensions as top 10', however the top 10" does not include cut-out section 64. The top 10" supports at least a single conventional electric heating element 11 that is secured to a heating mount has a cut-away section 67 having a diameter $D_2$ of about 14 inches (35.6 cm) and thickness $t_2$ of about ⅛ of an inch (3.2 mm) for securely holding a cover plate 116F. The top 10" comprises a center hole 117 extending through the top 10" having a length $L_4$ that is sufficient to contain a heating element. There is preferably a recess formed at the top of the center hole 117 between the center hole 117 and an outer edge 70 of cut-away section 67 having a length $L_5$ of about ¾ of an inch (19 mm).

There is further provided a second hole 19 adjacent to the center hole 117 in the tank's top for containing a thermostat and sensor. The second hole 19 is preferably a length $L_6$ of about 3 inches (7.6 cm) and a width $W_4$ of about 3 inches (7.6 cm). The top 10" also contains an opening 116C, which is preferably a deep recess having a length $L_7$ of about 3 inches (7.6 cm), width $W_7$ of about 2 inches (5.1 cm) and a height (not shown) of about 1½ inches (38.1 mm).

The tank 2 preferably has an inside diameter $D_3$ of about 18 inches (45.7 cm) and an outside diameter $D_4$ of about 23 inches (58.4 cm). The outer walls 5 of the tank 2 preferably extend a length $L_8$ of about 1¼ inches (31.8 mm) above the inner wall 4 and insulation 6 therebetween.

Thus, although there have been described particular embodiments of the present invention of a new and useful water heater, it is not intended that such references are construed as limitations upon the scope of this invention.

I claim:

1. An electric water heater comprising:

a tank having an inner wall and an outer wall wherein said inner wall and said outer wall are separated by a first open space region and said first open space region is filled at least partially with thermal insulation;

further wherein said water tank is adapted to hold a quantity of non-pressurized and non-circulating heat transfer liquid;

a top adapted to be separated from said tank, said top having an upper wall and lower wall wherein said upper wall and said lower wall are separated by a second open space region and said second open space region is filled at least partially with thermal insulation;

at least one thermally conductive coil adapted to circulate water from a water inlet, said coil being mounted inside said tank and having said water inlet and a water outlet in communication with an exterior of said tank, further wherein said water inlet and said water outlet each extends outside of said water heater;

at least one heating element attached to said top and positioned to extend downwardly through said top and heat said heat transfer liquid within said tank;

a sensor plate in communication with said coil in a position proximate to said water inlet and wherein said sensor plate extends from said top to said coil;

a thermostat connected to said sensor plate, wherein said thermostat is in thermal proximity with said sensor plate such that it activates said heating element when the temperature signaled by said sensor plate reaches a pre-determined temperature; and wherein said heating element contacts and heats the heat transfer liquid inside the tank and said heat transfer liquid contacts said coil to heat water from a water supply that enters said water heater and circulates through said coil such that heated water leaves said water outlet.

2. The water heater according to claim 1, wherein said sensor plate directly senses the temperature of the heat transfer liquid in the tank.

3. The water heater according to claim 1, wherein said coil has a finned outer surface.

4. The water heater according to claim 1, wherein said coil has a corrugated inner surface.

5. The water heater according to claim 1, wherein said open space region contains one or more layers of metallic foil.

6. The water heater according to claim 1, wherein the thermal insulation of the first or second open space is selected from the group consisting of cellulose, cardboard, corrugated cardboard, foam, recyclable paper, or cellulose fibers.

7. The water heater according to claim 6, wherein said thermal insulation is fire retardant.

8. The water heater according to claim 4, wherein the inner wall and outer wall of the tank and the upper wall and lower wall of the top are constructed from a plastic material.

9. The water heater according to claim 1, wherein one or more open air spaces exist between said thermal insulation and said walls.

10. The water heater according to claim 1, wherein said thermal insulation comprises multiple layers of insulation and wherein open air spaces exist between each layer of insulation.

11. The water heater according to claim 1, wherein said inner wall and said outer wall of said tank are spaced about 2 inches to about 4 inches apart.

12. The water heater according to claim 6, wherein said thermal insulation has a thickness of about ¼ of an inch to about 3 inches.

13. The water heater according to claim 1, wherein said heat transfer fluid is water.

14. The water heater according to claim 1, wherein said heating element is secured to a heating element mount and said heating element mount has a diameter larger than a center hole and said heating element mount rests atop said center hole in said top.

15. The water heater according to claim 14, further wherein said heating element mount is held atop said center hole by a lip section formed in said top.

16. The water heater according to claim 1, wherein the heating element extends through a center hole in said top.

17. The water heater according to claim 16, wherein the sensor plate extends inside a second hole formed in said top and wherein said second hole is proximate said center hole.

18. The water heater according to claim 1, wherein the thermostat is held in place on the sensor plate by a fastener.

19. The water heater according to claim 18, wherein said fastener is a spring clip.

20. The water heater according to claim 1, wherein the sensor plate is a copper plate.

21. The water heater according to claim 1, wherein the sensor plate is fixedly perpendicularly connected to a sensor.

22. The water heater according to claim 1, wherein the sensor plate is welded onto said water inlet.

23. The water heater according to claim 1, wherein a float is attached to said water inlet and said float is in communication with a valve for filling said tank.

24. An electric water heater comprising:

a tank having an inner wall and an outer wall wherein said inner wall and said outer wall are separated by at least a single first open space region and said first open space region is filled at least in part with thermal insulation; further wherein said water tank is adapted to hold a quantity of non-pressurized and non-circulating heat transfer liquid;

a top adapted to be separated from said tank, said top having an upper wall and lower wall wherein said upper wall and said lower wall are separated by at least a single second open space region and said second open space region is filled at least in part with thermal insulation;

said top further having an opening that can receive a heating element mount adapted to extend downwardly inside and fluidly communicate with said heat transfer fluid, wherein said mount is sealing engaged in said opening and held in place by a gasket and a lip having a larger diameter than said opening, at least one thermally conductive coil adapted to circulate water from a water inlet said coil being mounted inside said tank and having said water inlet and a water outlet in communication with an exterior of said tank, further wherein said water inlet and said water outlet each extends outside of said water heater;

at least one heating element mounted on said heating element mount and positioned to extend inside said heat transfer liquid within said tank;

a sensor block in communication with said coil for receiving water from said coil and returning water to said coil; and a thermostat mounted on a side of said heating element mount and in thermal proximity to said sensor block such that it activates said heating element when water temperature signaled by said sensor block reaches a pre-determined temperature.

25. The electric water heater of claim 24, wherein said sensor block is a hollow block.

26. The electric water heater of claim 24, wherein said sensor block is aligned with said thermostat to improve thermal contact between said sensor block and said thermostat.

27. The electric water heater of claim 24, wherein connectors for bringing water through said sensor block are positioned on different surfaces or on the same surface of the block.

* * * * *